US007150373B2

(12) United States Patent
Richter

(10) Patent No.: US 7,150,373 B2
(45) Date of Patent: Dec. 19, 2006

(54) TRANSPORT AND STORAGE DEVICE

(76) Inventor: Günter Richter, Johannistal 12, 57610 Altenkirchen (DE)

( * ) Notice: Subject to any disclaimer, the term of this patent is extended or adjusted under 35 U.S.C. 154(b) by 402 days.

(21) Appl. No.: 10/296,183

(22) PCT Filed: Mar. 2, 2001

(86) PCT No.: PCT/DE01/00799

§ 371 (c)(1),
(2), (4) Date: Jul. 21, 2003

(87) PCT Pub. No.: WO01/89942

PCT Pub. Date: Nov. 29, 2001

(65) Prior Publication Data

US 2004/0050850 A1 Mar. 18, 2004

(30) Foreign Application Priority Data

May 22, 2000 (DE) ..... 200 09 113 U

(51) Int. Cl.
*B65D 88/00* (2006.01)

(52) U.S. Cl. ..... 220/1.5; 220/495.05

(58) Field of Classification Search ..... 220/495.05, 220/495.06, 1.5, 23.87, 601, DIG. 6
See application file for complete search history.

(56) References Cited

U.S. PATENT DOCUMENTS

| | | | | |
|---|---|---|---|---|
| 2,952,379 | A * | 9/1960 | Potter | 220/6 |
| 3,964,636 | A * | 6/1976 | Rehrig | 220/495.06 |
| 4,054,219 | A * | 10/1977 | Young et al. | 215/375 |
| 4,676,373 | A * | 6/1987 | Schneider | 206/386 |
| 5,044,510 | A * | 9/1991 | Schutz | 220/4.05 |
| 5,226,558 | A | 7/1993 | Whitney et al. | |
| 5,474,197 | A | 12/1995 | Hillis et al. | |
| 5,501,334 | A * | 3/1996 | Przytulla et al. | 206/386 |
| 5,615,798 | A * | 4/1997 | Luburic et al. | 220/572 |
| 5,655,679 | A * | 8/1997 | Schutz | 220/1.6 |
| 5,680,955 | A * | 10/1997 | Schutz | 220/1.6 |
| 5,979,685 | A * | 11/1999 | Tz | 220/1.6 |
| 6,019,242 | A * | 2/2000 | Wysocki et al. | 220/571 |
| 6,202,844 | B1 * | 3/2001 | Sedlmayr | 206/386 |

FOREIGN PATENT DOCUMENTS

| | | |
|---|---|---|
| DE | 37 11 728 | 3/1991 |
| DE | 40 41 749 | 6/1992 |
| DE | 4433923 | 3/1996 |
| DE | 198 02 307 | 7/1999 |
| DE | 198 02 307 A1 | 7/1999 |
| EP | 0597769 | 5/1994 |
| WO | 9503231 | 2/1995 |

* cited by examiner

*Primary Examiner*—Nathan J. Newhouse
*Assistant Examiner*—Eugene Lhymn
(74) *Attorney, Agent, or Firm*—Friedrich Kueffner

(57) ABSTRACT

The invention relates to a device for transporting and/or storing an especially liquid medium, which comprises a relatively thin-walled plastic inner container (1) that receives the medium and an outer container (4) that encloses the inner container like a trough. At the top, said inner container (1) is provided with a filling opening that is configured as a threaded tube (2), and at the bottom, if required, with a drain opening (3). The outer container (4) consists of a pallet-type support (5) that supports the inner container (1) on its underside and a jacket (6) that adjoins the support (5). The inner container (1) is secured in the outer container (4) by means of a cover plate (8) fastened on the outer container (4).

5 Claims, 3 Drawing Sheets

TRANSPORT AND STORAGE DEVICE

BACKGROUND OF THE INVENTION

1. Field of the Invention

The invention concerns a container for shipping and/or storing a medium, especially a liquid medium, which consists of a relatively thin-walled plastic inner container that holds the medium and a tank-like outer container that encloses the inner container. A threaded tube that serves as the filling opening is provided at the top of the inner container, and, if necessary, a drain hole is provided at the bottom of the inner container. The outer container consists of a pallet-like support, which supports the bottom of the inner container, and of a wall joined to the support. The inner container is secured in the outer container by a cover plate fastened on the outer container.

2. Description of the Related Art

Liquid media, for example, chemicals, which in the past have been stored and shipped mostly in 200-L drums, are increasingly being stored and shipped in containers, referred to as shipping containers, that have volume capacities of about 500 to 1500 L. Containers of this type consist of an inner container and an outer container. The inner container is a thin-walled plastic container that has an externally threaded filling tube at the top, which can be closed by a screw cap. A drain hole with a closure device is usually provided at the bottom of the inner container. To prevent damage to the thin wall of the inner container, which can be replaced when necessary, the outer container has a tank-like shape. The outer container consists of a pallet-like support on which the inner container is supported. The support is joined to a wall, which may consist of metal or plastic. Over almost its entire surface area, the wall of the outer container lies securely, i.e., with no appreciable play, against the wall of the inner container. A special cover plate secures the inner container in the outer container. The cover plate usually has a collar that grips the upper edge of the outer container and is fastened to it with screws. In this type of container design, there is always the danger that, during the filling operation, liquid medium or other material being filled into the container can spill and get into the space between the inner container and the outer container, which is closed at the bottom. This is regarded as extremely disadvantageous, because this type of container, in its assembled state, is very difficult to clean.

SUMMARY OF THE INVENTION

Document DE-A-198 02 307 describes a container in accordance with the introductory clause of claim 1. The container has a cover plate that is fastened to the edge of an outer container with screws. The cover plate has an opening that is tightly sealed around the filling tube for the inner container. Overflowing material passes laterally along the cover plate and is carried to the outside by a runoff device.

U.S. Pat. No. 5,226,558 describes a storage container, in which the upper region of the container wall 41 has a filling tube that is recessed relative to an upper edge of the container. The recess is designed as an overflow channel, along which overflowing material is carried to the outside.

WO-A-95/03,231 describes a pallet container with a base pallet that supports a plastic inner container. The inner container has a filling tube that is recessed relative to the upper edge of the inner container. The recess in the inner container forms a channel, in which overflowing material is carried to the outside.

Therefore, the goal of the invention is to develop the previously known shipping container in such a way that material that spills during the filling operation can no longer get into the space between the inner container and the outer container.

To solve this problem in a shipping container of the type described above, it is proposed, in accordance with the invention, that the top of the inner container be provided with a cover plate that has a recess, that the recess have an opening that is tightly sealed around the filling tube, and that at least one overflow channel extend laterally from this recess away from the outer container.

With this design, medium or filling material that spills during the filling operation is first caught by the recess and then immediately drained off to the outside by the overflow channel. As a result, filling medium that is spilled can no longer enter the space between the inner container and outer container.

The invention will now be explained in greater detail with reference to the embodiments illustrated in the drawings.

BRIEF DESCRIPTION OF THE DRAWING

FIG. 1 shows a perspective drawing of a container for storing and/or shipping a medium, especially a liquid medium. The shipping container comprises a relatively thin-walled inner container 1 made of a suitable plastic. The inner container 1 has a cubic shape with rounded corners and edges, and the top of the inner container 1 has a filling opening formed by an externally threaded tube 2, which can be closed by a screw cap. In the embodiment of the invention shown here, the bottom of the inner container 1 has a drain hole 3 with a closure device.

DETAILED DESCRIPTION OF THE INVENTION

Figure 3:
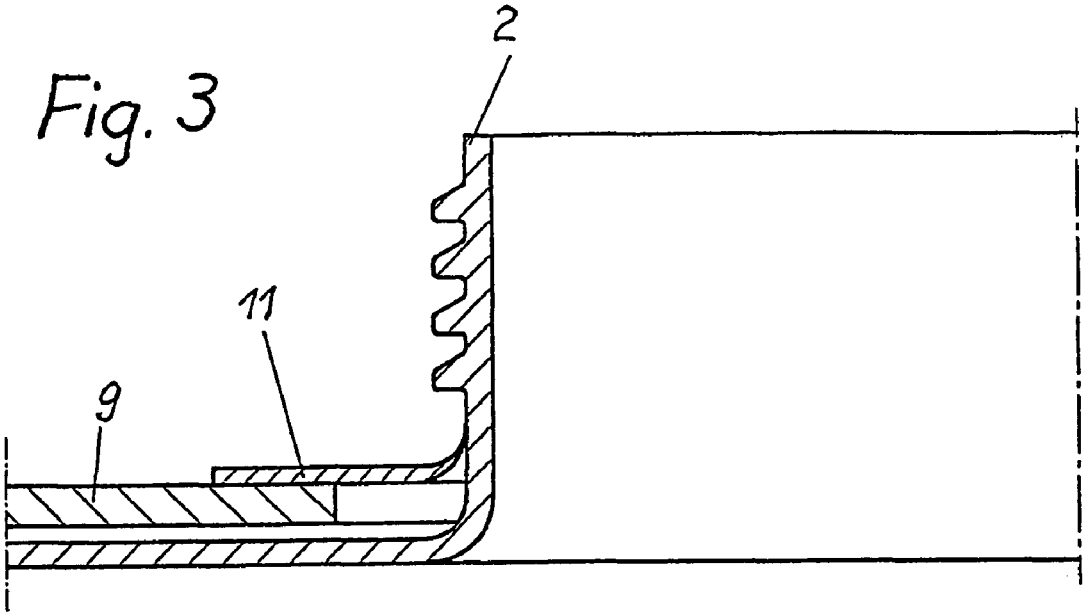
FIG. 3 shows a seal of the filling tube of the inner container.
Figure 4:
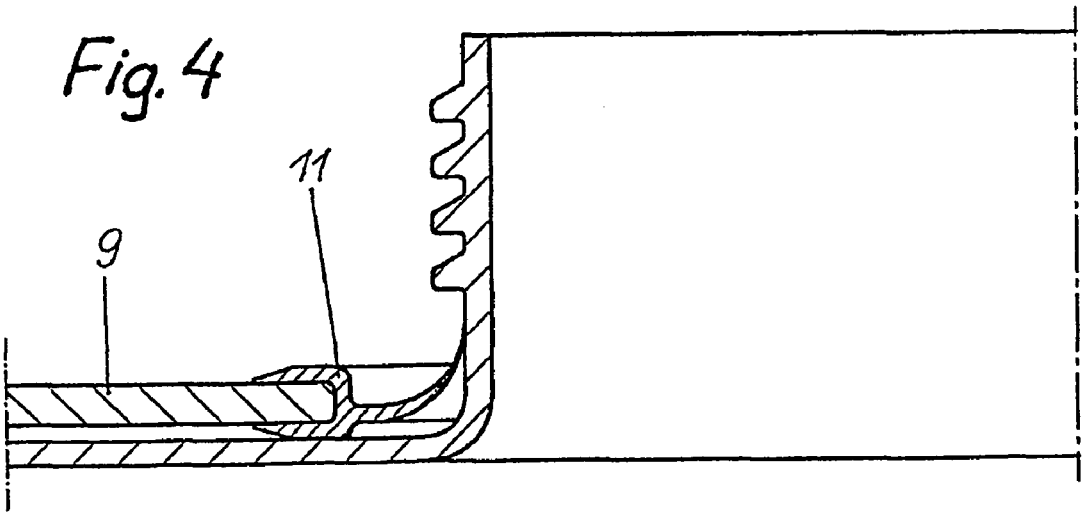
FIG. 4 shows a different seal design.

The inner container 1 is inserted in an outer container 4, which, for example, is also made of plastic. However, the outer container can also be made of metal, for example, sheet metal. The outer container 4 has a pallet-like support 5 for supporting the inner container 1. The lateral edges of the support 5 are joined to a wall 6, with which the inner container 1 is in contact over most of its surface area around the container. Thus, the wall 6 of the outer container 4 also supports the sides of the relatively thin-walled inner container 1. In the embodiment of the invention shown in the drawing, the upper edge 7 of the wall 6 of the outer container 4 extends a given length above the top surface of the inner container 1. A metal or plastic cover plate 8 is mounted on this edge 7 with a mounting flange 14. The mounting flange 14 can be fastened to the edge 7, for example, with screws. The cover plate 8 has a recess 9, which has an opening 10 that fits the filling tube 2 and is sealed from the tube. As shown in FIGS. 3 and 4, sealing is achieved by a seal 11, which is either mounted on the cover plate 8 with an adhesive or mounted in the opening of the cover plate 8. If the seal 11 and the cover plate 8 are suitably designed, the top of the inner container 1 is prevented from sinking. The mounting flange 14 of the cover plate 8, which is fastened to opposite edges 7 of the wall 6 of the outer container 4, also enhances the stability of the wall 6 and thus the stability of the shipping container as a whole.

Figure 1:
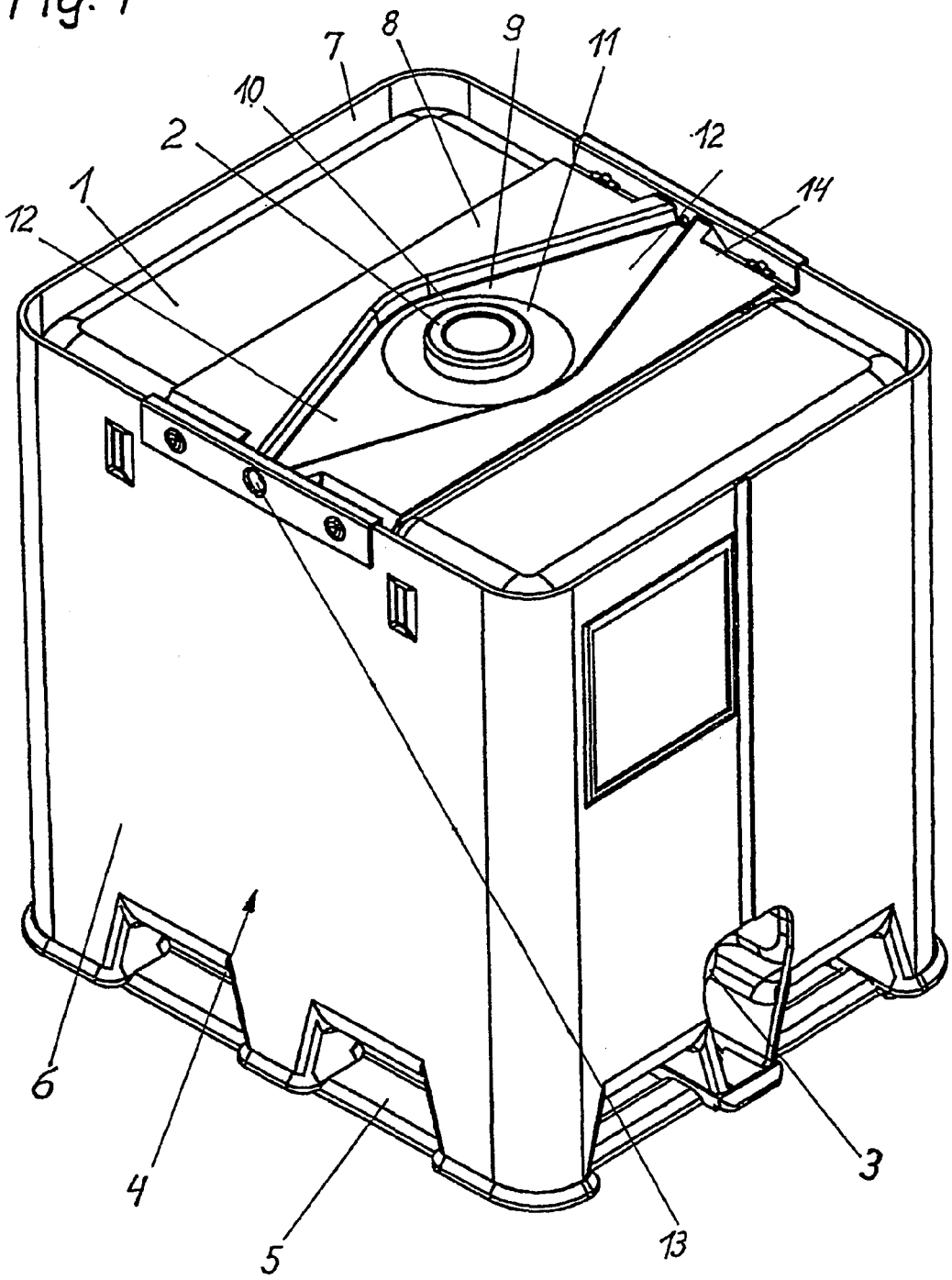
FIG. 1 shows a shipping container in accordance with the invention.

The recess 9 that surrounds the filling tube 2 tapers into two overflow channels 12, which lead to the outside and, in the embodiment shown in FIG. 1, open into holes 13 that are incorporated in the mounting flange 14 of the cover plate 8. If necessary, the upper edge 7 of the wall 6 has a recess at this point. Filling material that is spilled during the filling operation can run off to the outside without any problems via the recess 9, the overflow channels 12 and the holes 13.

Figure 2:
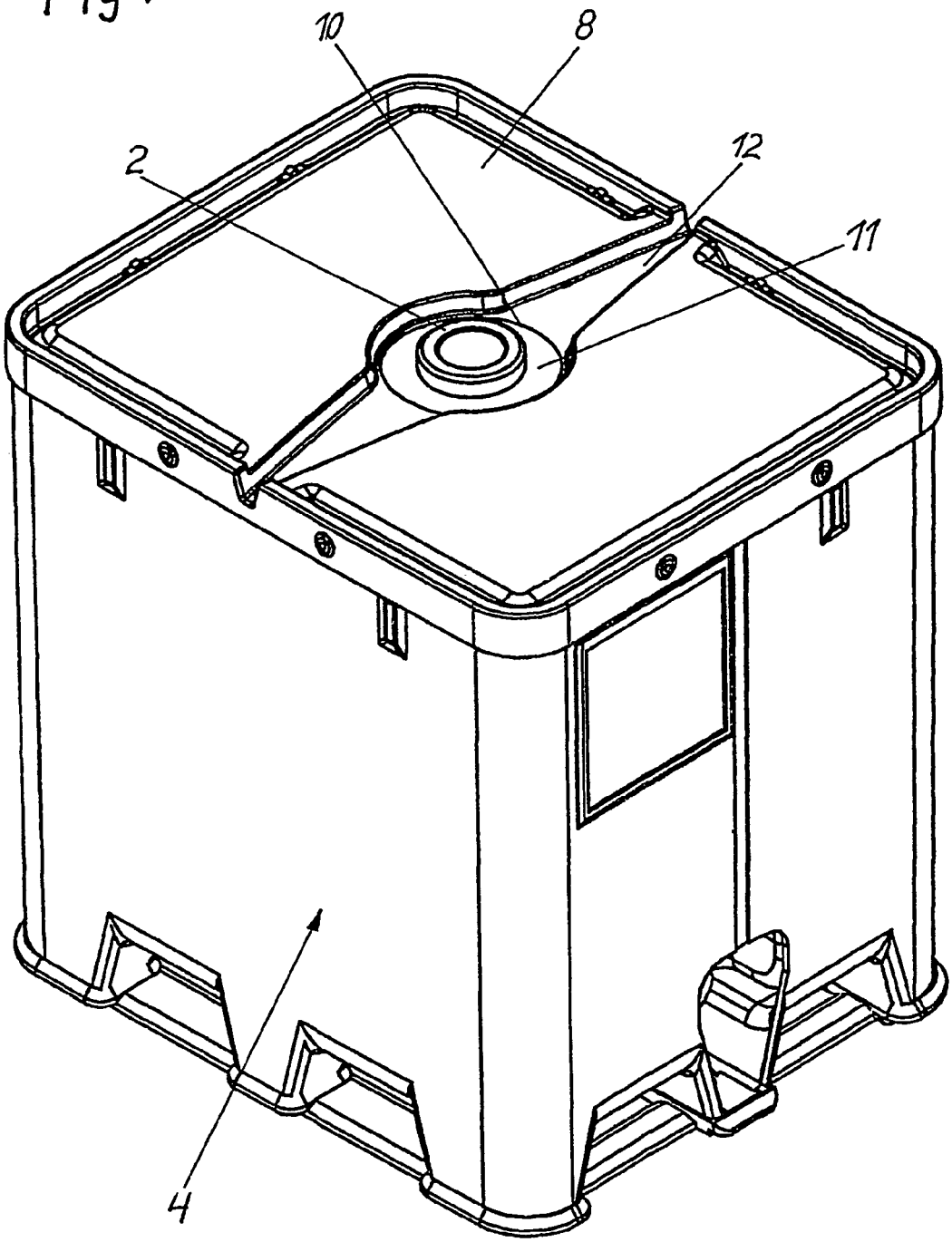
FIG. 2 shows another design of a shipping container in accordance with the invention.

The embodiment of the invention shown in FIG. 2 differs from the one shown in FIG. 1 in that the cover plate 8 extends over the entire top of the walls 6 of the outer container 4 and thus over the whole shipping container. Furthermore, there are no holes 13 in the mounting flange 14 of the cover plate 8, but rather gaps are provided in the mounting flange 14, so that the overflow channels 12 lead directly to the outside. This type of design may also be used for the cover plate 8 in FIG. 1 and vice versa.

The illustrated embodiments of the invention can also be modified with respect to the seal 11, which can be designed and installed in different ways. It is also possible to make the cover plate 8 itself from an elastic sealing material. Furthermore, the mounting flange 14 can be designed differently.

The invention claimed is:

1. A container for shipping and/or storing a liquid medium, the container comprising a relatively thin-walled plastic inner container having a top and a bottom for holding the medium;

a tank-like outer container enclosing the inner container;

a filling opening formed by a threaded tube provided at the top of the inner container;

a drain hole provided at the bottom of the inner container;

wherein the outer container is comprised of a pallet-like support for supporting the bottom of the inner container, and a wall joined to the support; and wherein a cover plate mounted on the top of the inner container having a recess, wherein the recess has an opening tightly sealed around the threaded tube, and wherein at least one overflow channel extends laterally from the recess beyond the outer container.

2. The container according to claim 1, wherein two overflow channels are arranged on opposite sides of the cover plate.

3. The container according to claim 1, wherein the cover plate has a mounting flange, and wherein the at least one overflow channel extends through the mounting flange.

4. The container according to claim 1, wherein the at least one overflow channel is integrally formed in a mounting flange of the cover plate.

5. The container according to claim 1, wherein the opening in the cover plate has a gasket for fitting the opening to the threaded tube.

* * * * *